US005122087A

United States Patent [19]

Coccoli et al.

[11] Patent Number: 5,122,087

[45] Date of Patent: Jun. 16, 1992

[54] DOMINO GAME

[76] Inventors: Mario Coccoli, 801 Terrace Pl., Peekskill, N.Y. 10566; George Spector, 233 Broadway Room 3815, New York, N.Y. 10007

[21] Appl. No.: 735,444

[22] Filed: Jul. 22, 1991

[51] Int. Cl.[5] ..... A63H 33/00

[52] U.S. Cl. ..... 446/2

[58] Field of Search ..... 273/459, 86, 86 D; 446/2

[56] References Cited

U.S. PATENT DOCUMENTS

| | | | |
|---|---|---|---|
| 2,289,690 | 7/1942 | Bakalyar | 446/2 |
| 2,503,142 | 4/1950 | Tullgren et al. | 446/2 |
| 2,587,042 | 2/1952 | Haiselup | 446/2 |
| 4,138,797 | 2/1979 | Stolar | 446/2 |
| 4,358,274 | 11/1982 | Chase | 446/2 X |
| 4,632,664 | 12/1986 | Manning | 446/2 |

*Primary Examiner*—Paul E. Shapiro

[57] ABSTRACT

A toppling toy game is provided which consists of an elongated flexible cord member and a plurality of plate members. A mechanism is for pivotally mounting each of the plate members to the elongated flexible cord member, so as to move about an axis of rotation between an upright position and an inclined position separating from the elongated flexible cord member. The plate members are so spaced apart from one another at horizontal intervals less then the heights of the plate members when in their upright positons, so that when the leading plate member is toppled backward it will successively and sequentially effect backward toppling of the following plate members, thereby producing the domino effect.

3 Claims, 1 Drawing Sheet

DOMINO GAME

BACKGROUND OF THE INVENTION

The instant invention relates generally to games and more specifically it relates to a toppling toy game which provides a row of rectangular blocks connected by a cord and stood on end will fall in succession when the first rectangular block is pushed.

There are available various conventional games which do not provide the novel improvements of the invention herein disclosed.

SUMMARY OF THE INVENTION

A primary object of the present invention is to provide a toppling toy game that will overcome the shortcomings of the prior art devices.

Another object is to provide a toppling toy game that includes a row of rectangular blocks which are connected together by a cord and stood on end, which will fall in succession when the first rectangular block is pushed, thereby producing the domino effect.

An additional object is to provide a toppling toy game in which each rectangular block contains a stop wedge so as to normally keep the rectangular block in a vertical position when the cord is pulled back after the rectangular blocks fall over.

A further object is to provide a toppling toy game that is simple and easy to use.

A still further object is to provide a toppling toy game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
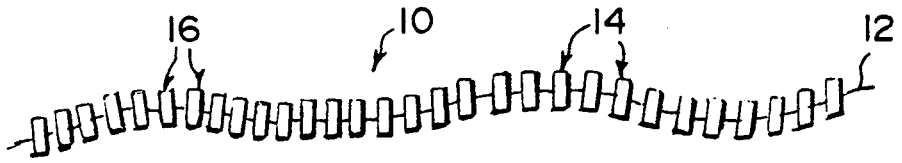
FIG. 1 is a diagrammatic top plan view of the instant invention in a generally straight line.

Turning now descriptively to the drawings, in which similar reference characters denote similar elements throughout the several views, the Figures illustrate a toppling toy game 10 which consists of an elongated flexible cord member 12, a plurality of plate members 14 and a mechanism 16 for pivotally mounting each of the plate members 14 to the elongated flexible cord member 12, so as to move about an axis of rotation between an upright position and an inclined position without separating from the elongated flexible cord member 12. The plate members 14 are so spaced apart from one another at horizontal intervals less than the heights of the plate members 14, when in their upright positions. When the leading plate member 14 is toppled backward it will successively and sequentially effect backward toppling of the following plate members 14, thereby producing the domino effect.

Each of the plate members 14 is a small rectangular block 16, having a central U-shaped notch 18 in its bottom edge 20 which fits over the elongated flexible cord member 12. The pivotally mounting mechanism 16 includes a plurality of pins 22, each extending through the lower side edges 2 of the small rectangular block 16 at the central U-shaped notch 18 and transversely through the center of the elongated flexible cord member 12.

The toppling toy game 10 further includes a plurality of wedge stops 26, with each formed on a front surface 28 of each small rectangular block 16 about the central U-shaped notch 18. An outwardly extending bottom surface 30 on each wedge stop 26, will normally keep each small rectangular block 16 in its upright position when a person pulls back on said elongated flexible cord member 12, after the small rectangular blocks 16 topple into their inclined positions.

Figure 2:
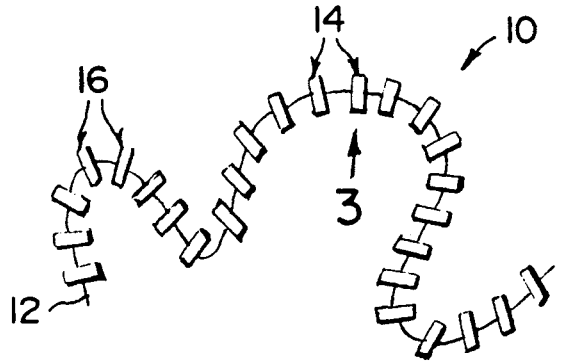
FIG. 2 is a diagrammatic top plan view of the instant invention in a curved line.
Figure 3:
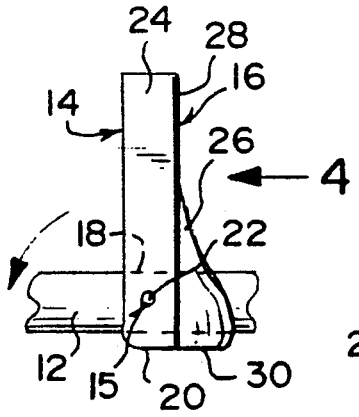
FIG. 3 is a side view taken in direction of arrow 3 in FIG. 2, showing one of the plate members in greater detail.
Figure 4:
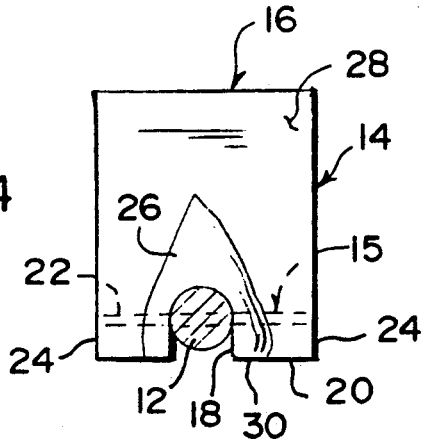
FIG. 4 is a front view taken in direction of arrow 4 in FIG. 3, showing the stop wedge on the plate member in greater detail.

The elongated flexible cord member 12 of the toppling toy game 10 can be placed in a generally straight line, as shown in FIG. 1, or placed in a curved line, as shown in FIG. 2, so as to change the shape when playing the game.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A toppling toy game which comprises:

a) an elongated flexible cord member;

b) a plurality of plate members; and c) means for pivotally mounting each of said plate members to said elongated flexible cord member, so as to move about an axis of rotation between an upright position and an inclined position without separating from said elongated flexible cord member, said plate members being so spaced apart from one another at horizontal intervals less than the heights of said plate members when in their upright positions, so that when said leading plate member is toppled backward it will successively and sequentially effect backward toppling of said following plate members, thereby producing the dominoe effect; wherein each of said plate members is a small rectangular block having a central U-shaped notch in its bottom edge which fits over said elongated flexible cord member.

2. A toppling toy game as recited in claim 1, wherein said pivotally mounting means includes a plurality of pins, each extending through the lower side edges of said small rectangular block at the central U-shaped notch and transversely through the center of said elongated flexible cord member.

3. A toppling toy game as recited in claim 2, further including a plurality of wedge stops, each formed on a front surface of each said small rectangular block about the central U-shaped notch, so that an outwardly extending bottom surface on each said wedge stop will normally keep each said small rectangular block in its upright position when a person pulls back on said elongated flexible cord member after said small rectangular blocks topple into their inclined positions.

* * * * *